US006892658B1

(12) United States Patent
Chang

(10) Patent No.: US 6,892,658 B1
(45) Date of Patent: May 17, 2005

(54) SEWING MACHINE

(76) Inventor: Tseng Hsien Chang, 9F, No. 270, Gaogong Rd., South District, Taichung 402 (TW)

( * ) Notice: Subject to any disclaimer, the term of this patent is extended or adjusted under 35 U.S.C. 154(b) by 0 days.

(21) Appl. No.: 10/690,508

(22) Filed: Oct. 23, 2003

(51) Int. Cl.[7] ..... D05B 37/06
(52) U.S. Cl. ..... 112/122
(58) Field of Search ..... 112/122, 122.1, 112/129, 130, 44, 68; 83/285, 306, 559, 679, 936

(56) References Cited

U.S. PATENT DOCUMENTS 3,745,948 A * 7/1973 Desperak et al. ..... 112/122.1
4,649,841 A * 3/1987 Koshinaka ..... 112/129
5,289,789 A * 3/1994 Sakuma ..... 112/122
5,813,356 A * 9/1998 Nolle ..... 112/122
6,725,790 B2 * 4/2004 Sadasue ..... 112/125

* cited by examiner

*Primary Examiner*—Ismael Izaguirre
(74) *Attorney, Agent, or Firm*—Rosenberg, Klein & Lee

(57) ABSTRACT

A sewing machine includes a main frame provided with a drive shaft, and a cutting mechanism mounted on the main frame and driven by the drive shaft. The cutting mechanism includes a driving device, a first retaining device, and a second retaining device. Thus, the cutting mechanism is operated rigidly and stably, thereby facilitating the user operating the sewing machine.

20 Claims, 6 Drawing Sheets

SEWING MACHINE

BACKGROUND OF THE INVENTION

1. Field of the Invention

The present invention relates to a sewing machine, and more particularly to a sewing machine having a cutting mechanism that is operated rigidly and stably, thereby facilitating the user operating the sewing machine.

2. Description of the Related Art

A conventional sewing machine comprises a fixed lower cutter, and an upper cutter mounted on a support seat and movable relative to the lower cutter. The support seat is moved horizontally and vertically so as to adjust the position of the upper cutter. However, the support seat cannot support the upper cutter rigidly and stably, so that the upper cutter easily vibrates during movement, thereby decreasing the working efficiency. In addition, the lower cutter is not positioned exactly, so that when the upper cutter touches the lower cutter to cut the cloth, the lower cutter is easily deflected, thereby affecting quality of the cloth.

SUMMARY OF THE INVENTION

The present invention is to mitigate and/or obviate the disadvantage of the conventional sewing machine.

The primary objective of the present invention is to provide a sewing machine, wherein the support rod is extended through the passage hole of the actuating member and the support hole of the support bracket, so that support rod and the upper cutter are supported by the actuating member and the support bracket rigidly and stably, thereby enhancing efficiency of operation of the upper cutter.

Another objective of the present invention is to provide a sewing machine, wherein the support rod is supported by the actuating member and the support bracket, and the restoring spring is urged between the retaining member and the actuating member, so that the whole length of the support rod is shortened efficiently, thereby simplifying the construction of the sewing machine.

A further objective of the present invention is to provide a sewing machine, wherein the whole length of the support rod is shortened efficiently, thereby reducing shock or vibration during adjustment of the support rod, thereby enhancing stability of operation of the upper cutter.

A further objective of the present invention is to provide a sewing machine, wherein the actuating member of the driving device and the main frame form a parallel four-link structure, so that the upper cutter and the actuating member are constantly moved upward and downward in a parallel manner, thereby exactly maintaining the optimum angle between the upper cutter and the lower cutter.

A further objective of the present invention is to provide a sewing machine, wherein the fixing seat has mediate portion fixed on the support shaft and a lower end mounted on the second pivot shaft of the main frame, thereby forming a resistant force structure having a longer moment, so that when the upper cutter intersects the lower cutter to cut the cloth, the upper cutter and the lower cutter are kept at the optimum stable state for cutting the cloth.

A further objective of the present invention is to provide a sewing machine, wherein the upper cutter, the support rod, the lower cutter and the fixing seat are support rigidly and stably, thereby reducing hit, shock or vibration during operation of the sewing machine, thereby enhancing stability of operation of the sewing machine, and thereby increasing the lifetime of the sewing machine.

In accordance with one embodiment of the present invention, there is provided a sewing machine, comprising:

a main frame provided with a drive shaft; and a cutting mechanism mounted on the main frame and including:

a driving device including an actuating member driven by the drive shaft of the main frame;

a first retaining device including a support bracket secured on and spaced from the actuating member, a support rod driven by the actuating member of the driving device and having a first end extended through the actuating member and the support bracket, an upper cutter mounted on a second end of the support rod to move therewith, a retaining member secured on the first end of the support rod and rested on the support bracket, a restoring spring mounted on the support rod and urged between the retaining member and the actuating member; and a second retaining device including a lower cutter located opposite to the upper cutter of the first retaining device.

In accordance with another embodiment of the present invention, there is provided a sewing machine, comprising:

a main frame provided with a drive shaft; and a cutting mechanism mounted on the main frame and including:

a driving device driven by the drive shaft of the main frame;

a first retaining device including an upper cutter driven by the driving device; and a second retaining device including a support shaft having a first end extended through a wall of the main frame, a fixing seat having a mediate portion secured on a second end of the support shaft and a lower end mounted on a pivot shaft of the main frame, and a lower cutter secured on an upper end of the fixing seat and located opposite to the upper cutter of the first retaining device.

In accordance with a further embodiment of the present invention, there is provided a sewing machine, comprising:

a main frame provided with a drive shaft; and a cutting mechanism mounted on the main frame and including:

a driving device driven by the drive shaft of the main frame and including a drive member having an upper end mounted on the drive shaft of the main frame, a first power transmission member having a first section pivotally mounted on a lower end of the drive member and a mediate section pivotally mounted on a pivot axle of the main frame, a link having a first end pivotally mounted on a second section of the first power transmission member, a second power transmission member having a first section pivotally mounted on a second end of the link and a mediate section pivotally mounted on a pivot shaft of the main frame, and an actuating member having a lower end pivotally mounted on a second section of the second power transmission member;

a first retaining device including an upper cutter driven by the actuating member of the driving device; and a second retaining device including a lower cutter located opposite to the upper cutter of the first retaining device.

Further benefits and advantages of the present invention will become apparent after a careful reading of the detailed description with appropriate reference to the accompanying drawings.

DETAILED DESCRIPTION OF THE INVENTION

Figure 1:
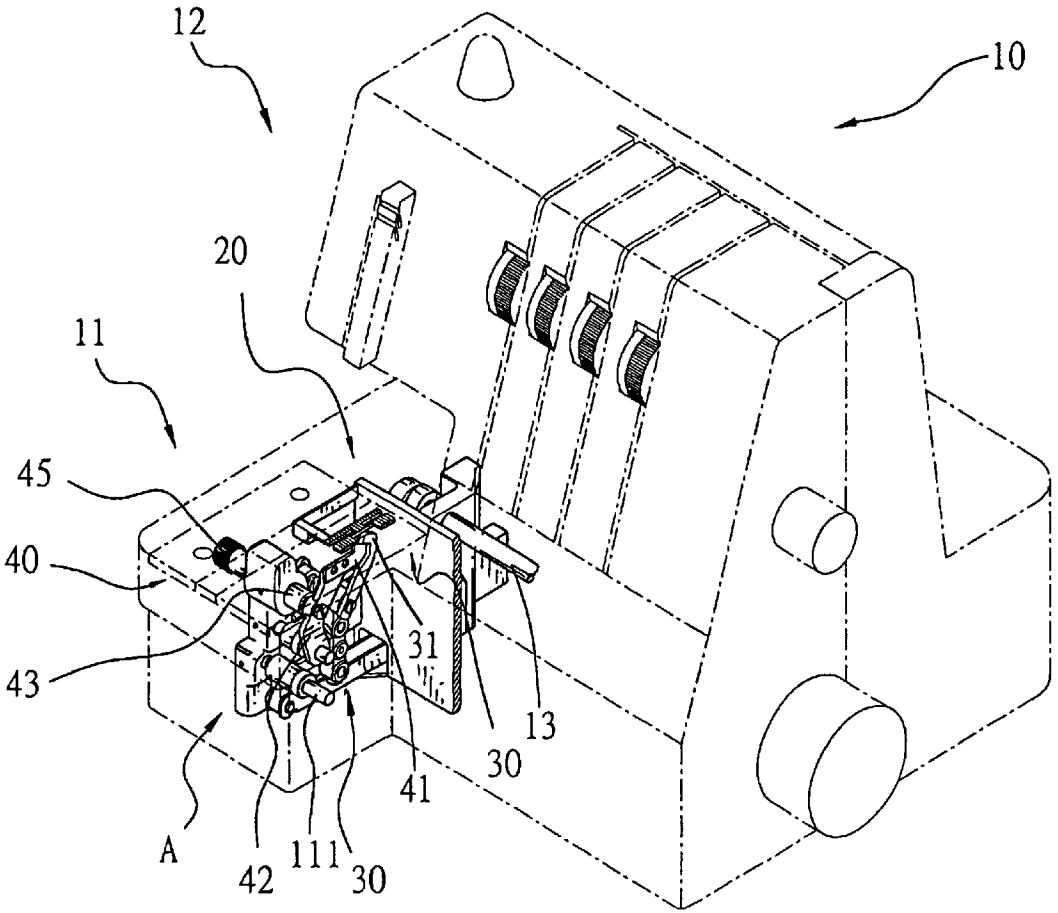
FIG. 1 is a perspective view of a sewing machine in accordance with the preferred embodiment of the present invention.
Figure 2:
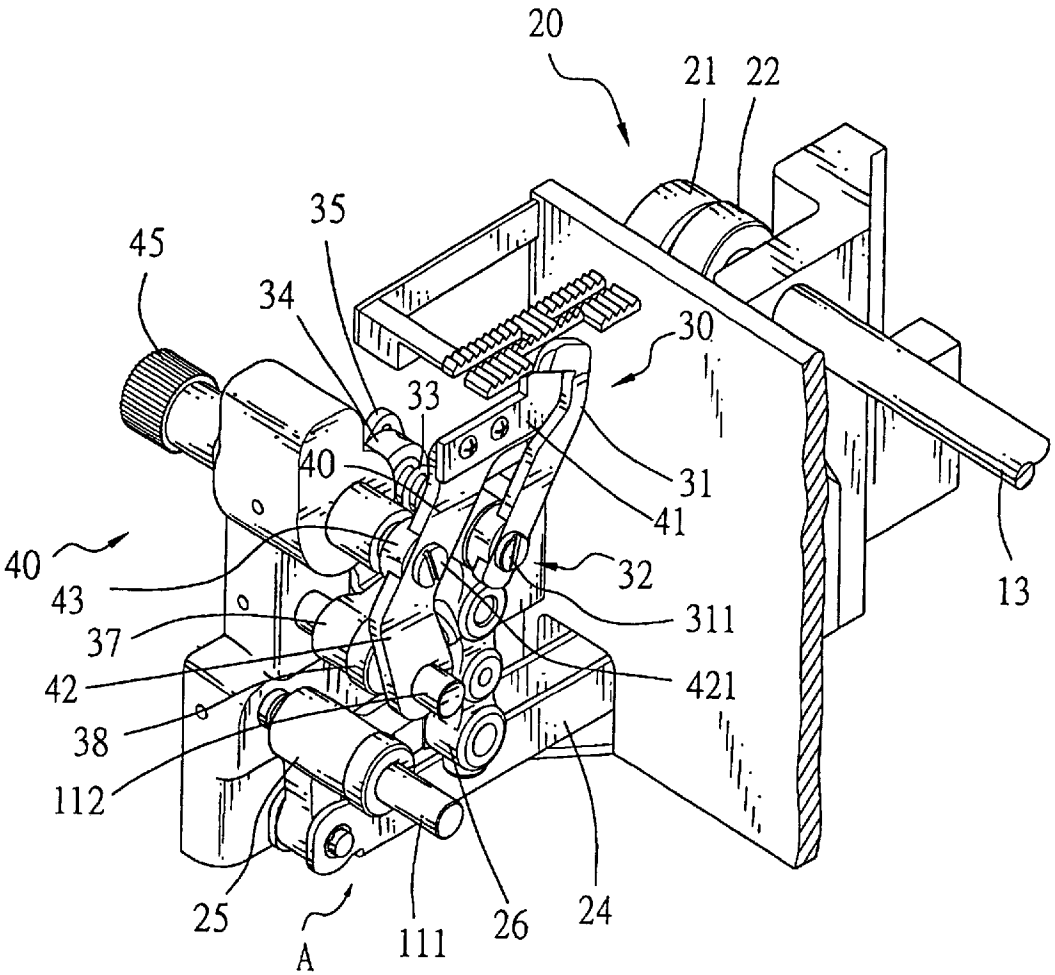
FIG. 2 is a partially cut-away perspective view of the sewing machine in accordance with the preferred embodiment of the present invention.
Figure 3:
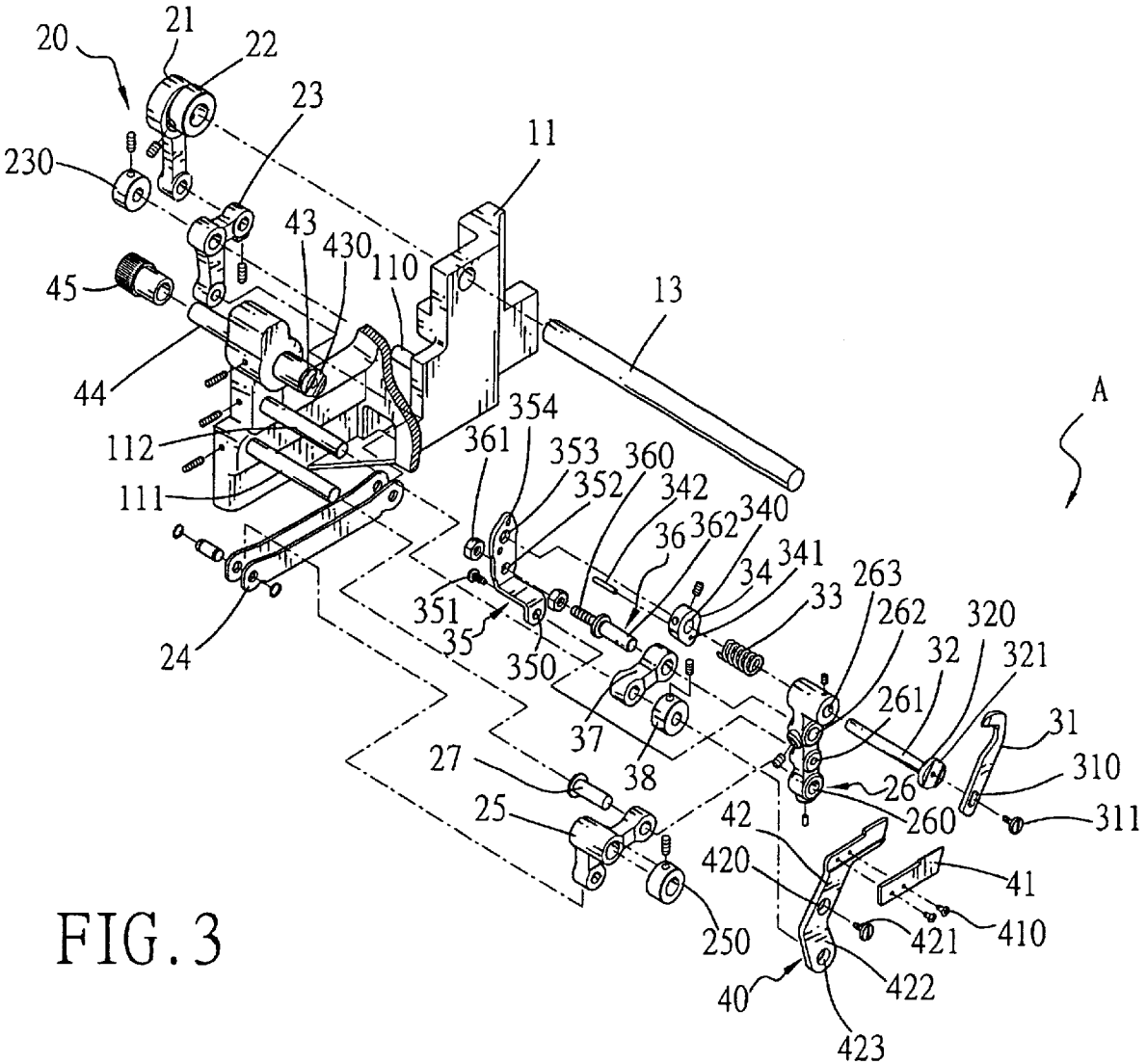
FIG. 3 is an exploded perspective view of the sewing machine in accordance with the preferred embodiment of the present invention.
Figure 4:
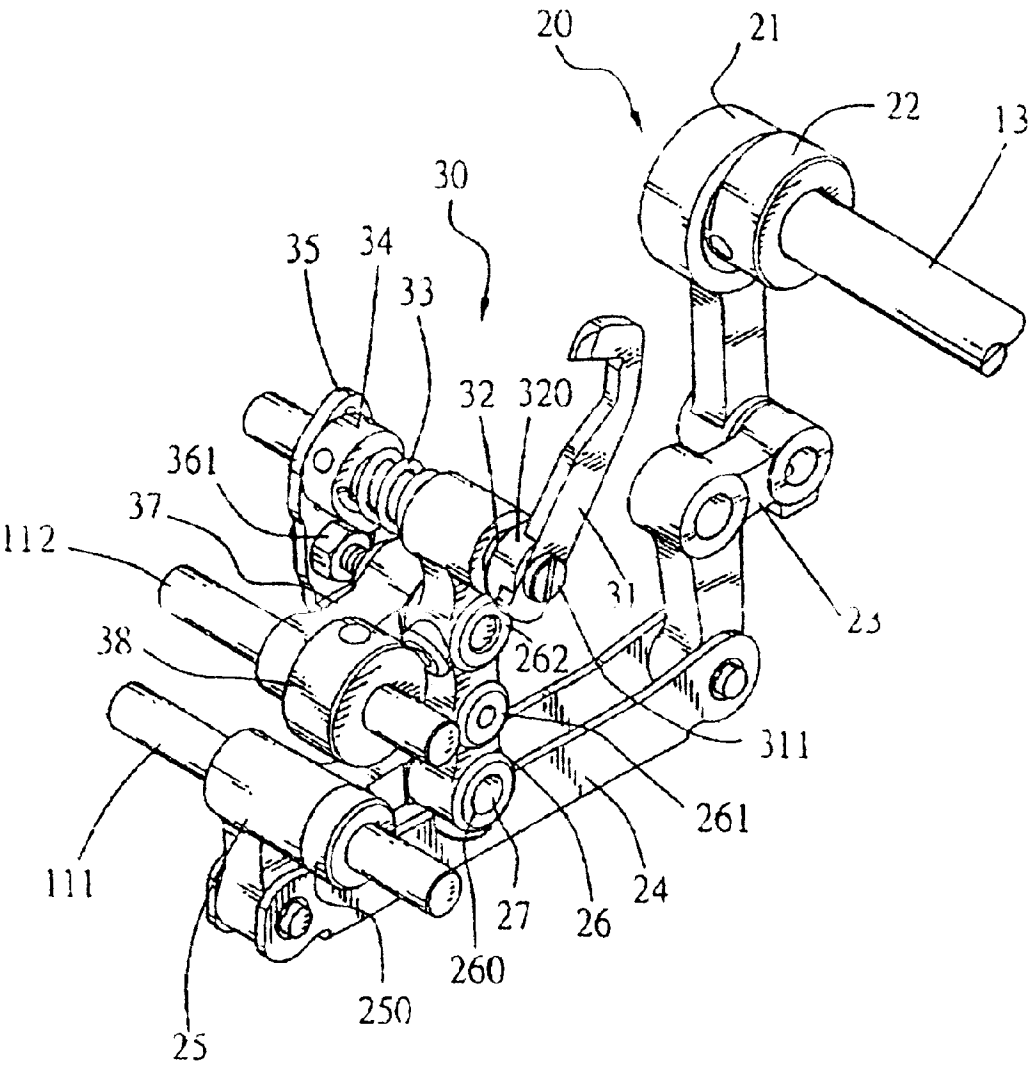
FIG. 4 is a partially cut-away perspective view of the sewing machine in accordance with the preferred embodiment of the present invention.
Figure 5:
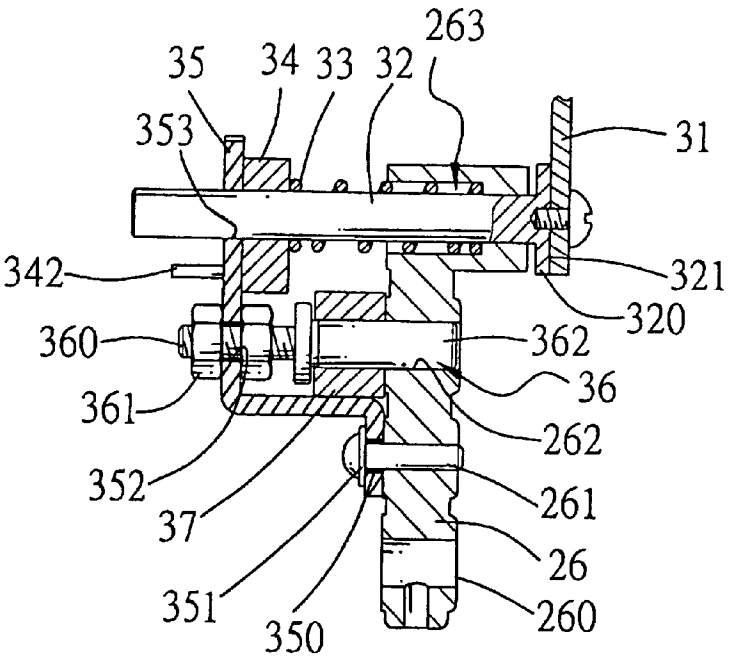
FIG. 5 is a partially cut-away plan cross-sectional view of the sewing machine as shown in FIG. 4.
Figure 6:
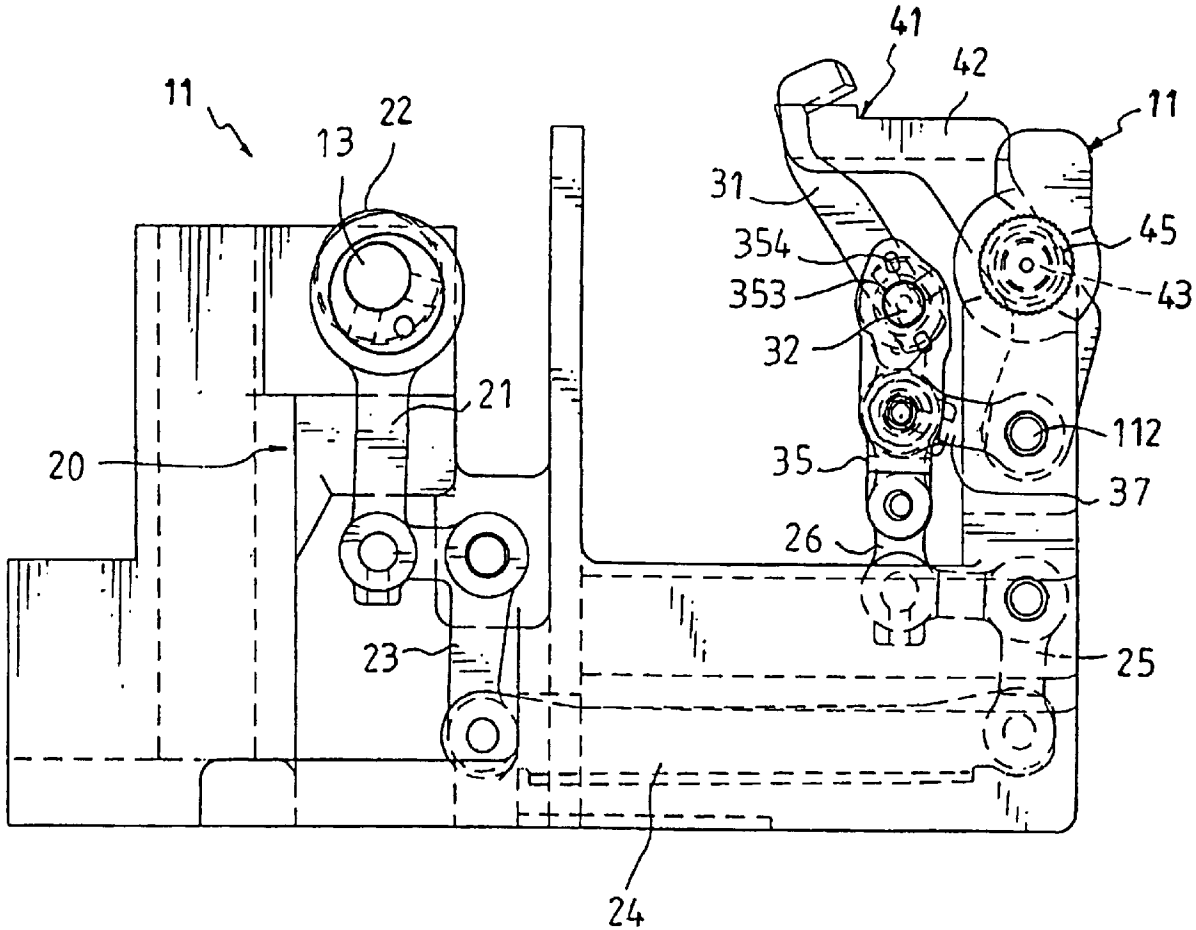
FIG. 6 is a plan operational view of the sewing machine as shown in FIG. 2.

Referring to the drawings and initially to FIGS. 1–3, a sewing machine 10 in accordance with the preferred embodiment of the present invention comprises a main frame 11, a cantilever 12 mounted on a top of the main frame 11, and a cutting mechanism "A" mounted on the main frame 11 for cutting the cloth. The main frame 11 is provided with a drive shaft 13 for driving the cutting mechanism "A".

The cutting mechanism "A" includes a first retaining device 30 having an upper cutter 31, a second retaining device 40 having a lower cutter 41, and a driving device 20 driven by the drive shaft 13 of the main frame 11 to drive the upper cutter 31 of the first retaining device 30.

In such a manner, the first retaining device 30 can so-operate with the second retaining device 40, so that the upper cutter 31 of the first retaining device 30 and the lower cutter 41 of the second retaining device 40 are supported rigidly and stably by multiple support points.

The main frame 11 has a wall provided with a pivot axle 110, a first pivot shaft 111 and a second pivot shaft 112 for mounting the driving device 20, the first retaining device 30 and the second retaining device 40.

Referring to FIGS. 1–6, the driving device 20 includes a drive member 21 having an upper end mounted on the drive shaft 13 of the main frame 11 by a fixing member 22, a substantially inverted L-shaped first power transmission member 23 having a horizontal section pivotally mounted on a lower end of the drive member 21 and a mediate section pivotally mounted on the pivot axle 110 of the main frame 11 by a fixing member 230, a horizontal link 24 having a first end pivotally mounted on a vertical section of the first power transmission member 23, a substantially inverted L-shaped second power transmission member 25 having a vertical section pivotally mounted on a second end of the link 24 and a mediate section pivotally mounted on the first pivot shaft 111 of the main frame 11 by a fixing member 250, and an elongated actuating member 26 having a lower end pivotally mounted on a horizontal section of the second power transmission member 25. The lower end of the actuating member 26 is formed with a pivot hole 260, and a pivot pin 27 is extended through the horizontal section of the second power transmission member 25 and is pivotally mounted in the pivot hole 260 of the lower end of the actuating member 26. In addition, the fixing member 22 is fixed on the drive shaft 13 of the main frame 11 to rotate therewith, and the drive member 21 is moved on the fixing member 22 to perform a cam movement.

The actuating member 26 has a mediate portion formed with a threaded fixing hole 261 located above the pivot hole 260 and a positioning hole 262 located above the fixing hole 261 and an upper end formed with a passage hole 263 located above the positioning hole 262.

The first retaining device 30 includes a substantially L-shaped support bracket 35 having a horizontal section secured on the mediate portion of the actuating member 26, a support rod 32 having a first end extended through the passage hole 263 of the actuating member 26 and a vertical section of the support bracket 35 and a second end formed with an enlarged head 320 rested on the upper end of the actuating member 26 for mounting a lower end of the upper cutter 31, an annular retaining member 34 secured on the first end of the support rod 32 and rested on the vertical section of the support bracket 35, and a restoring spring 33 mounted on the support rod 32 and urged between the retaining member 34 and a wall of the passage hole 263 of the actuating member 26.

The enlarged head 320 of the support rod 32 of the first retaining device 30 is formed with a positioning recess 321 for positioning the lower end of the upper cutter 31 by an adjusting screw 311. In addition, the lower end of the upper cutter 31 is formed with an oblong adjusting slot 310 for slidably mounting the adjusting screw 311.

The retaining member 34 of the first retaining device 30 is formed with a central hole 340 for mounting the support rod 32. The vertical section of the support bracket 35 has an upper end formed with a support hole 353 for mounting the support rod 32 and two retaining holes 354 surrounding the support hole 353, the retaining member 34 has a periphery formed with a retaining hole 341, and the first retaining device 30 further includes a retaining pin 342 having a first end secured in the retaining hole 341 of the retaining member 34 and a second end secured in one of the two retaining holes 354 of the support bracket 35.

The horizontal section of the support bracket 35 has a bent end formed with a fixing hole 350, and the first retaining device 30 further includes a locking screw 351 extended through the fixing hole 350 of the support bracket 35 and screwed into the fixing hole 261 of the actuating member 26, so that the horizontal section of the support bracket 35 is fixed on the mediate portion of the actuating member 26. Thus, the support bracket 35 is integrally combined with the actuating member 26, so that the support bracket 35 is moved with the actuating member 26 synchronously.

The first retaining device 30 further includes a follower 37 having a first end pivotally mounted between the support bracket 35 and the actuating member 26 by a positioning shaft 36, and a second end pivotally mounted on the second pivot shaft 112 of the main frame 11 by a fixing member 38.

In such a manner, the main frame 11, the actuating member 26, the second power transmission member 25 and the follower 37 form a parallel four-link structure, so that the actuating member 26 is moved upward and downward in a parallel manner.

The vertical section of the support bracket 35 has a lower end formed with a fixing hole 352, and the positioning shaft 36 has a threaded first end 360 extended through the fixing hole 352 of the support bracket 35 and screwed by two locking nuts 362. In addition, the positioning shaft 36 has a smooth second end 362 extended through the first end of the follower 37 and secured in the positioning hole 262 of the actuating member 26, so that the follower 37 is pivotally mounted on the positioning shaft 36.

The second retaining device 40 includes a support shaft 43 having a first end 44 extended through a wall of the main frame 11 and a second end formed with a positioning recess 430, a knob 45 fixed on the first end 44 of the support shaft 43, a fixing seat 42 having an upper end for fixing the lower cutter 41 by screws 410, a mediate portion formed with a through hole 420 and a lower end 422 formed with a mounting hole 423 mounted on the second pivot shaft 112 of the main frame 11, and a locking screw 421 extended through the through hole 420 of the fixing seat 42 and screwed into the positioning recess 430 of the support shaft 43.

In such a manner, when the upper cutter 31 of the first retaining device 30 and the lower cutter 41 of the second retaining device 40 touch each other, the through hole 420 of the fixing seat 42 forms the fulcrum of a resistant force, and the mounting hole 423 of the fixing seat 42 forms a resistant moment of a longer distance, thereby enhancing stability of the lower cutter 41 and the fixing seat 42 of the second retaining device 40 when cutting the cloth rim.

Accordingly, the sewing machine in accordance with the preferred embodiment of the present invention has the following advantages.

1. The support rod 32 is extended through the passage hole 263 of the actuating member 26 and the support hole 353 of the support bracket 35, so that support rod 32 and the upper cutter 31 are supported by the actuating member 26 and the support bracket 35 rigidly and stably, thereby enhancing the efficiency of operation of the upper cutter 31.

2. The support rod 32 is supported by the actuating member 26 and the support bracket 35, and the restoring spring 33 is urged between the retaining member 34 and the actuating member 26, so that the whole length of the support rod 32 is shortened, thereby simplifying the construction of the sewing machine.

3. The whole length of the support rod 32 is shortened efficiently, thereby reducing shock or vibration during adjustment of the support rod 32, thereby enhancing stability of operation of the upper cutter 31.

4. The actuating member 26 of the driving device 20 and the main frame 11 form a parallel four-link structure, so that the upper cutter 31 and the actuating member 26 are constantly moved upward and downward in a parallel manner, thereby exactly maintaining the optimum angle between the upper cutter 31 and the lower cutter 41.

5. The fixing seat 42 has mediate portion fixed on the support shaft 43 and a lower end 422 mounted on the second pivot shaft 112 of the main frame 11, thereby forming a resistant force structure having a longer moment, so that when the upper cutter 31 intersects the lower cutter 41 to cut the cloth, the upper cutter 31 and the lower cutter 41 are kept at the optimum stable state for cutting the cloth.

6. The upper cutter 31, the support rod 32, the lower cutter 41 and the fixing seat 42 are support rigidly and stably, thereby reducing hit, shock or vibration during operation of the sewing machine, thereby enhancing stability of operation of the sewing machine, and thereby increasing the lifetime of the sewing machine.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A sewing machine, comprising:

a main frame provided with a drive shaft; and a cutting mechanism mounted on the main frame and including:

a driving device including an actuating member driven by the drive shaft of the main frame;

a first retaining device including a support bracket secured on and spaced from the actuating member, a support rod driven by the actuating member of the driving device and having a first end extended through the actuating member and the support bracket; and a second retaining device including a lower cutter located opposite to the upper cutter of the first retaining device.

2. The sewing machine in accordance with claim 1, wherein the first retaining device further includes a support bracket secured on and spaced from the actuating member, a support rod driven by the actuating member of the driving device and having a first end extended through the actuating member and the support bracket, an upper cutter mounted on a second end of the support rod to move therewith, a retaining member secured on the first end of the support rod and rested on the support bracket, and a restoring spring mounted on the support rod and urged between the retaining member and the actuating member.

3. The sewing machine in accordance with claim 1, wherein the support bracket has an upper end formed with a support hole for mounting the support rod.

4. The sewing machine in accordance with claim 2, wherein the support bracket has an upper end formed with two retaining holes, the retaining member has a periphery formed with a retaining hole, and the first retaining device further includes a retaining pin having a first end secured in the retaining hole of the retaining member and a second end secured in one of the two retaining holes of the support bracket.

5. The sewing machine in accordance with claim 1, wherein the first end of the support rod is extended through a passage hole of the actuating member.

6. The sewing machine in accordance with claim 2, wherein the retaining member of the first retaining device is formed with a central hole for mounting the support rod.

7. The sewing machine in accordance with claim 1, wherein the support bracket is substantially L-shaped.

8. The sewing machine in accordance with claim 2, wherein the support rod has a second end formed with an enlarged head rested on an upper end of the actuating member for mounting a lower end of the upper cutter.

9. The sewing machine in accordance with claim 8, wherein the enlarged head of the support rod of the first retaining device is formed with a positioning recess for positioning the lower end of the upper cutter by an adjusting screw.

10. The sewing machine in accordance with claim 9, wherein the lower end of the upper cutter is formed with an oblong adjusting slot for slidably mounting the adjusting screw.

11. The sewing machine in accordance with claim 2, wherein the support bracket has a bent end formed with a fixing hole, and the first retaining device further includes a locking screw extended through the fixing hole of the support bracket and screwed into a fixing hole of the actuating member, so that the support bracket is fixed on the actuating member.

12. The sewing machine in accordance with claim 2, wherein the first retaining device further includes a follower having a first end pivotally mounted between the support bracket and the actuating member by a positioning shaft, and a second end pivotally mounted on a pivot shaft of the main frame by a fixing member.

13. The sewing machine in accordance with claim 12, wherein the support bracket has a lower end formed with a fixing hole, and the positioning shaft has a threaded first end extended through the fixing hole of the support bracket and screwed by two locking nuts.

14. The sewing machine in accordance with claim 13, wherein the positioning shaft has a smooth second end extended through the first end of the follower and secured in the positioning hole of the actuating member, so that the follower is pivotally mounted on the positioning shaft.

15. A sewing machine, comprising:

a main frame provided with a drive shaft; and a cutting mechanism mounted on the main frame and including:

a driving device driven by the drive shaft of the main frame;

a first retaining device including an upper cutter driven by the driving device; and a second retaining device including a support shaft having a first end extended through a wall of the main frame, a fixing seat having a mediate portion secured on a second end of the support shaft and a lower end mounted on a pivot shaft of the main frame, and a lower cutter secured on an upper end of the fixing seat and located opposite to the upper cutter of the first retaining device.

16. The sewing machine in accordance with claim 15, wherein the second retaining device further includes a knob fixed on the first end of the support shaft.

17. A sewing machine, comprising:

a main frame provided with a drive shaft; and a cutting mechanism mounted on the main frame and including:

a driving device driven by the drive shaft of the main frame and including a drive member having an upper end mounted on the drive shaft of the main frame, a first power transmission member having a first section pivotally mounted on a lower end of the drive member and a mediate section pivotally mounted on a pivot axle of the main frame, a link having a first end pivotally mounted on a second section of the first power transmission member, a second power transmission member having a first section pivotally mounted on a second end of the link and a mediate section pivotally mounted on a pivot shaft of the main frame, and an actuating member having a lower end pivotally mounted on a second section of the second power transmission member;

a first retaining device including an upper cutter driven by the actuating member of the driving device; and a second retaining device including a lower cutter located opposite to the upper cutter of the first retaining device.

18. The sewing machine in accordance with claim 17, wherein the first power transmission member is substantially inverted L-shaped, and the second power transmission member is substantially inverted L-shaped.

19. The sewing machine in accordance with claim 17, wherein the fixing member is fixed on the drive shaft of the main frame to rotate therewith, and the drive member is moved on the fixing member to perform a cam movement.

20. The sewing machine in accordance with claim 17, wherein the lower end of the actuating member is formed with a pivot hole, and a pivot pin is extended through the second section of the second power transmission member and is pivotally mounted in the pivot hole of the lower end of the actuating member.

* * * * *